US005470215A

United States Patent [19]

Stone

[11] Patent Number: 5,470,215

[45] Date of Patent: Nov. 28, 1995

[54] WEAR RESISTANT VANE-TYPE FLUID POWER CONVERTER

[75] Inventor: Stephen R. Stone, San Antonio, Tex.

[73] Assignee: Rineer Hydraulics, Inc., San Antonio, Tex.

[21] Appl. No.: 296,626

[22] Filed: Aug. 26, 1994

[51] Int. Cl.[6] ..... F01C 1/344

[52] U.S. Cl. ..... 418/266; 418/221

[58] Field of Search ..... 418/221, 248, 418/258, 266, 267

[56] References Cited

U.S. PATENT DOCUMENTS

| | | | |
|---|---|---|---|
| 105,796 | 7/1870 | Fuller | 418/266 |
| 232,901 | 10/1880 | Phillips | 418/258 |
| 1,287,034 | 12/1918 | Johnson . | |
| 1,665,762 | 4/1928 | Waream . | |
| 1,776,452 | 9/1930 | Rosenthal | 418/258 |
| 2,231,440 | 2/1941 | Fess | 418/258 |
| 2,373,457 | 4/1945 | Chisholm, Jr. | 418/248 |
| 2,378,097 | 6/1945 | Piron . | |
| 2,855,002 | 10/1958 | Schiller . | |
| 2,964,014 | 12/1960 | Quintard | 418/266 |
| 3,030,056 | 4/1962 | Rogers . | |
| 3,256,594 | 6/1966 | Howard et al. . | |
| 3,479,923 | 11/1969 | Tripp | 418/248 |
| 3,779,537 | 12/1973 | Kalister . | |
| 4,521,005 | 6/1985 | Calderoni | 267/179 |
| 4,599,058 | 7/1986 | Stone | 418/221 |
| 4,778,161 | 10/1988 | Douillet | 267/179 |
| 5,056,764 | 10/1991 | Mochizuki | 267/291 |
| 5,173,578 | 12/1992 | Tama | 267/179 |
| 5,241,823 | 9/1993 | Stone et al. | 60/487 |
| 5,246,215 | 9/1993 | Takamura et al. | 267/179 |
| 5,255,640 | 10/1993 | Pierce | 267/179 |
| 5,261,801 | 11/1993 | Stone | 418/69 |

FOREIGN PATENT DOCUMENTS

| | | | |
|---|---|---|---|
| 207742 | 2/1968 | U.S.S.R. | 418/267 |
| 258859 | 4/1970 | U.S.S.R. | 418/266 |

*Primary Examiner*—John J. Vrablik
*Attorney, Agent, or Firm*—Fulbright & Jaworski

[57] ABSTRACT

A fluid power converter, such as a vane-type hydraulic motor comprising a rotor circumferentially surrounded by a stator, the opposing peripheral surfaces thereof creating an annular space therebetween. The opposing surfaces of the rotor and stator each exhibit a plurality of spaced apart radially extending slots for receiving a vane assembly therein. The vane assembly comprises a vane protruding from the slot, a spring located beneath the vane in the slot for forcing an outer edge of the vane against the opposing stator or rotor peripheral surface, respectively. A spring button is placed between the spring and the vane to prevent wear between the vane and the spring by allowing the oscillating vane to wear on the spring button instead of the spring. A notch may be formed in the edge of the vane which contacts the spring button to prevent the spring and spring button from rubbing against the endplate or housing.

4 Claims, 4 Drawing Sheets

WEAR RESISTANT VANE-TYPE FLUID POWER CONVERTER

BACKGROUND OF THE INVENTION

1. Field of the Invention

The present invention is directed to a vane-type fluid power converter, and more particularly, to a vane-type hydraulic motor having a spring button located between a vane and a spring to prevent the spring from coming into contact with the vane or with the end plate or housing.

2. Description of the Related Technology

It is known generally in the prior art to provide hydraulic motors and pumps having a rotor circumferentially surrounded by a stator, each of the rotor and stator exhibiting spring loaded vane elements protruding from slots in the surface thereof and having an outer edge in sliding contact with the opposing surface. Such motors and pumps can experience performance deterioration or catastrophic failure due to wear between the spring and vane element. When the rotor, vanes and springs rotate, the springs rub against the bottom of the vane and against the plate or housing adjacent to each side of the stator. As the spring rotates, it continues to rub on both the vane and the plate or housing. The continued rubbing causes spring wear which can cause the spring to break either on the face of its diameter where it touches the vane or along its length where it touches the plate or housing. When the spring breaks, the motor performance deteriorates, or a broken segment of the springs can wedge itself between the rotating or stationery components and cause catastrophic failure.

The spring wear between the spring and vane occurs because the vane slightly but continually vacillates within the vane slot within which it lies as fluid pressure is alternatingly applied to and released from the portion of the vane extending from the vane slot. This vacillation causes a milling and rubbing action to occur between the upper end of the spring and the bottom of the vane, thus causing wear on the upper portion of the spring which is in contact with the vane. Furthermore, the spring is trapped between a spring pocket in the rotor and the plate or housing. Compression of the spring causes the spring to buckle and rub on the stationary plate or housing as the rotor rotates. Such rubbing causes wear on the side of the spring that falls in contact with the stationary plate or housing.

For the foregoing reasons, there is a need for a vane-type fluid power converter wherein the spring is prevented from coming in contact with the vane and plate or housing, thus preventing spring wear.

SUMMARY OF THE INVENTION

The present invention is directed to a vane-type fluid power converter which reduces spring wear by preventing the spring from coming in contact with the vane and plate or housing. A wear resistant fluid power converter having features of the present invention comprises a rotor circumferentially surrounded by a stator creating an annular space therebetween. The outer surface of the rotor exhibits a plurality of radially extending slots, each slot configured to receive a vane assembly. The vane assembly comprises a biasing element, such as a helical compression spring, located in the bottom of the slot, a spring button covering the free end of the biasing element, and a vane having a lower edge resting upon an upper surface of the spring button.

The spring button, which is placed between the spring and the vane, prevents wear between the vane and the diameter of the spring by allowing the oscillating vane to wear on the spring button instead of the spring. The spring button has round extension which projects into the inside diameter of the spring. The vane incorporates a notch or indention which prevents the spring button from moving toward the plate or housing. The positioning of the notch is calculated so that the spring cannot rub against the plate or housing by virtue of the fact that the spring inside diameter comes in contact with the outside diameter of the spring button projection and the head of the spring button comes in contact with the lip of the notch on the vane, which prevents the outside diameter of the spring from coming into contact with the face of the plate or housing.

It is an object of the present invention to prevent wear between the spring and vane in a fluid power converter such as a vane-type hydraulic motor or pump. It is a further object of the invention to prevent wear between the spring and plate or housing adjacent each side of the stator in a hydraulic motor or pump.

These and other features, aspects, and advantages of the present invention will become better understood with regard to the following description, claims, and accompanying drawings.

DESCRIPTION OF THE PREFERRED EMBODIMENTS

While the present invention will be described in connection with one type of fluid power converter for purposes of illustration only, the present invention may be utilized in other and various types of vane-type fluid power converters.

Figure 1:
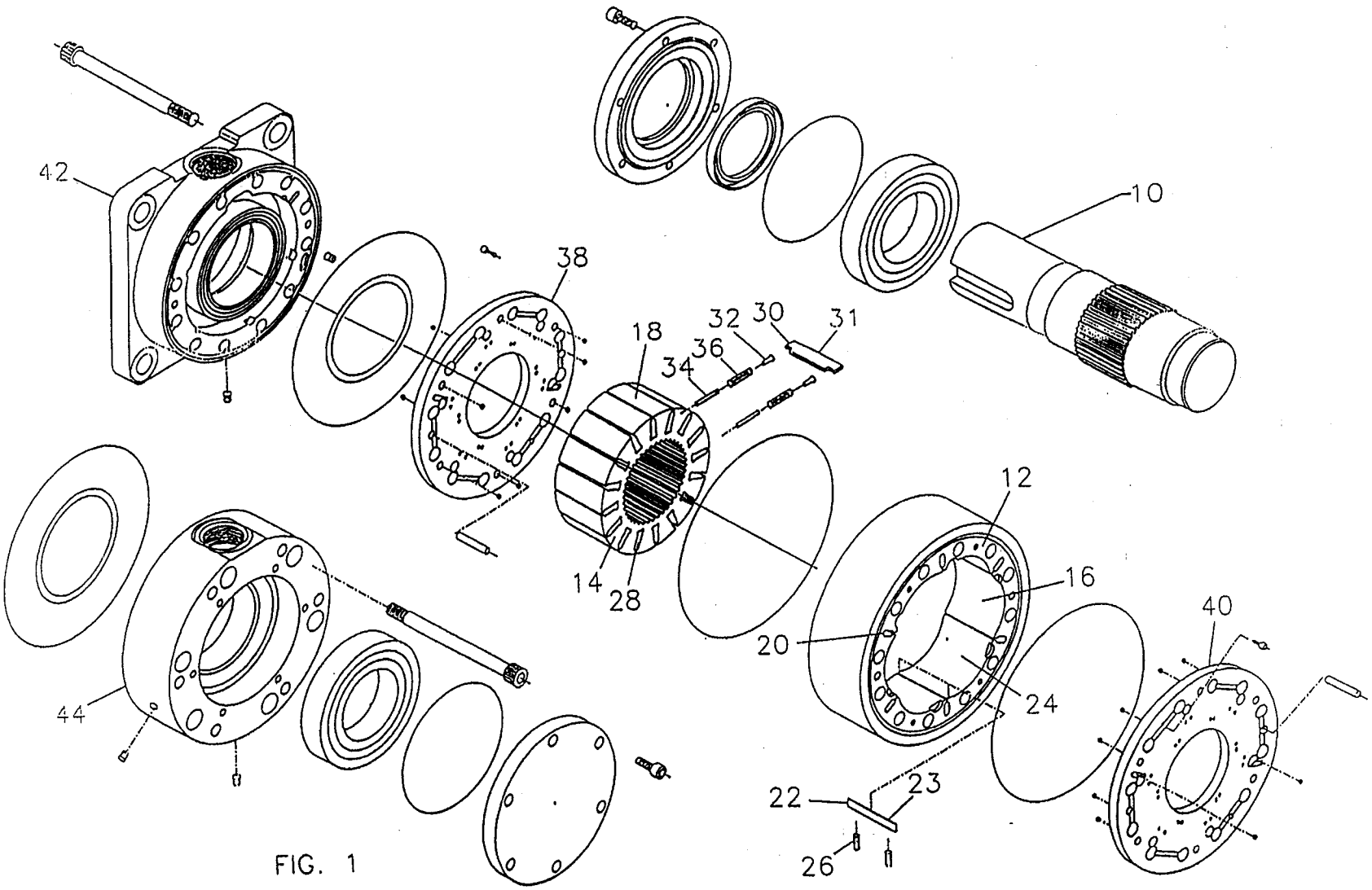
FIG. 1 is an exploded perspective view of a hydraulic motor embodying features of the present invention.

FIG. 1 depicts an illustrative and preferred embodiment of the invention. The reference 10 generally indicates a fluid power converter, namely a hydraulic motor, in which the member 12 is a stator and the member 14 is a rotor.

The inner periphery 16 of the stator 12 and the outer periphery 18 of the rotor 14 are suitably contoured to provide an annular fluid space therebetween. The stator 12 includes a plurality of radially extending vane slots 20, each of which receives a vane element 22 having an outer edge or tip 23 contacting the outer periphery 18 of the rotor 14. The inner periphery 16 of the stator 12 is defined by a series of concaved surfaces 24. The vane slots 20 are located at the locations on the inner periphery 16 most proximate to the centerline of the hydraulic motor 10. Each vane element 22 extends only slightly from each vane slots 20 to provide a continuous fluid seal against the rotor 14 between the concave areas 24. Each vane element 22 is biased against the rotor 14 by springs 26.

The rotor 14 includes radially extending vane receiving slots 28 which receive vane elements 30. Each vane element 30 has an outer edge or tip 31 which engages the inner periphery 16 of the stator 12, a spring button 32, and a first spring 34 circumferentially surrounded by a second spring 36. The springs are required to force the vane 30 out against the opposing peripheral surface. It is desirable to have a spring at each lower end of each vane. Therefore each vane has a spring or dual springs on each side of the rotor. According to the preferred embodiment, the springs 26, 34 and 36 are helical compression springs. The rotor 14, vanes 30, spring buttons 32 and springs 34 and 36 rotate inside of the stator 12.

Plates 38 and 40 are placed adjacent to each side of the stator 12. The rotor 14, stator 12, and plates 38 and 40 are encased by front housing 42 and rear housing 44. In other styles of vane-type hydraulic motors, only a housing is placed adjacent to each side of the stator.

In operation, hydraulic fluid is forced through a port in the stator 12 into the annular space defined by the rotor 14 and the concave surface 24 of the inner periphery 16. The hydraulic fluid so forced presses against vanes 30, causing the rotor 14 to rotate. As the rotor 14 rotates, the springs 34 and 36 expand and contract as required to insure that the vane 30 is sealingly in contact with the concave surface 24 of the inner periphery 16. At an appropriate point known to those skilled in the art, the hydraulic fluid so forced is drained from the annular space through a second port in the stator 12. The vanes 23 maintain a fluid seal between the concave surfaces 24. The vanes 23 of the stator 12 are machined relative to the vanes 30 to allow the vanes 30 to pass over the vanes 23 as the rotor 14 rotates.

Figure 2:
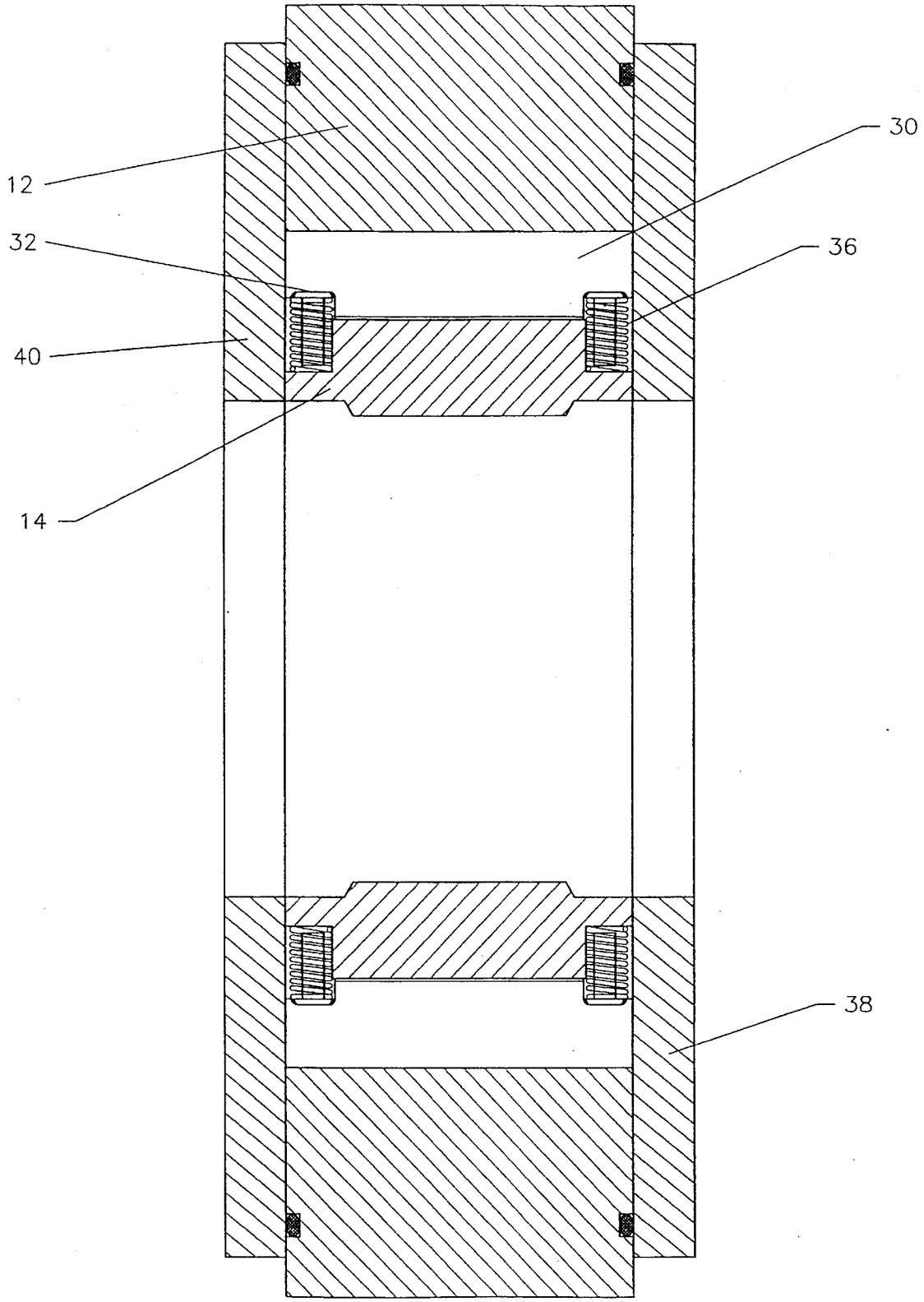
FIG. 2 is a side sectional view of a rotor and stator assembly of a hydraulic motor embodying features of the present invention.
Figure 4:
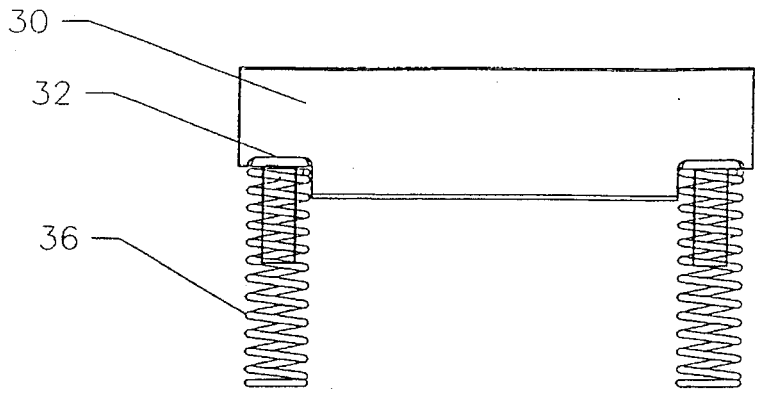
FIG. 4 is a front plan view of a vane assembly according to an embodiment of the present invention.
Figure 3:
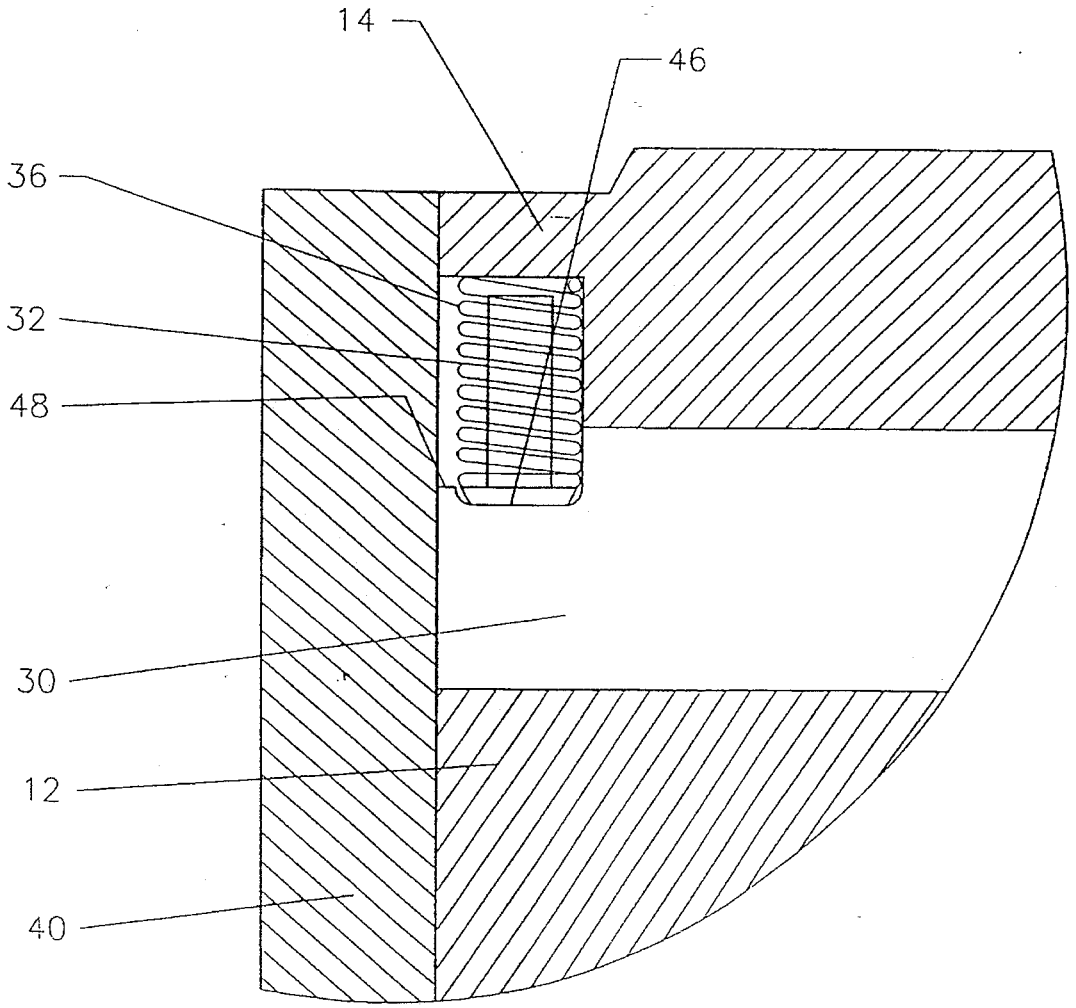
FIG. 3 is an enlarged sectional view of a portion of the rotor and stator assembly shown in FIG. 2.
Figure 6:
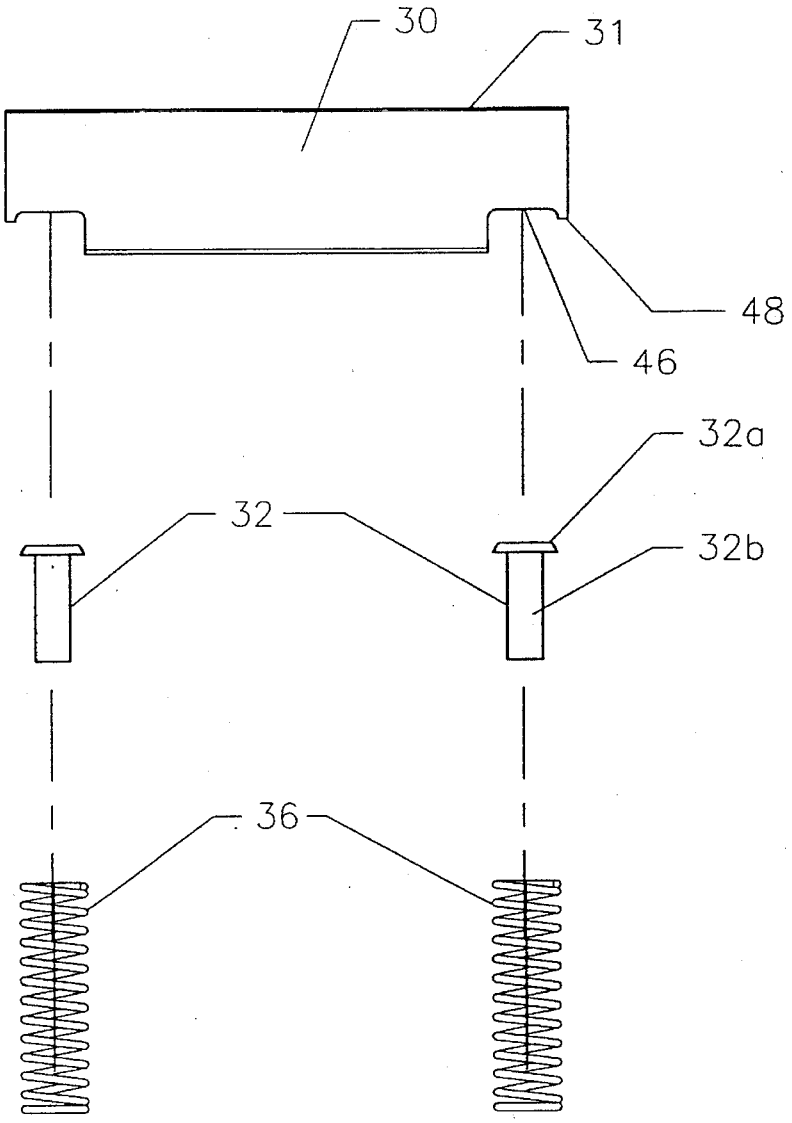
FIG. 6 is an exploded view of the vane assembly shown in FIG. 4.
Figure 5:
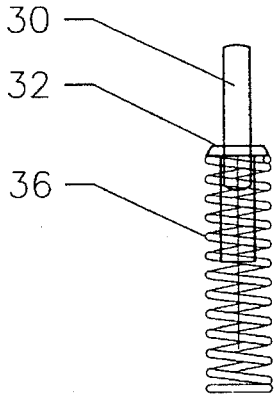
FIG. 5 is a side plan view of the vane assembly shown in FIG. 4.

The spring button 32 is comprised of a circular head **32*a* preferably exhibiting a chamfered upper surface, and preferably having a round extension 32*b* which extends from a lower surface of the spring button head 32*a* into the inside diameter of the spring 36. As best seen in FIGS. 2 and 3, a notch 46 is formed in the lower edge of the vane which comes into contact with the spring button head 32*a*. An outer lip 48 of the notch 46 prevents the spring button 32 from moving toward the adjacent plate 40 or 38. The positioning of the notch 46 is calculated so that the spring 36 cannot rub against the plate 40 or plate 38 by virtue of the fact that the spring inside diameter comes in contact with the outside diameter of the spring button projection 32*b* and the spring button head 32*a* comes in contact with the lip 48 of the notch 46 on the vane 30 which prevents the outside diameter of the spring 36 from coming into contact with the face of the plate 40 or plate 38. The chamfered spring button head 32*a* prevents wear between the lower edge of the vane 30 and the diameter of the spring 36 by allowing the oscillating vane 30 to wear on the spring button 32 instead of the spring 36. The round extension 32*b* prevents the spring 36 from buckling and, thus, rubbing against the plate 40 or plate 38**.

The present invention, therefore, is well adapted to carry out the objects and attain the ends and advantages mentioned as well as others inherent therein. The illustrated embodiments are shown by way of example only. The spirit and scope of the invention is not to be restricted by the preferred embodiments shown. "Button" as used in the disclosure is intended to mean a wear resistant apparatus that is integral with a vane-type hydraulic motor spring assembly and which protects the spring from wear.

I claim:

1. A fluid power converter comprising:

a rotor rotatably displaced between first and second plates, the rotor having first and second ends in slidable contact with the first and second plates;

the rotor defining rotor vane slots, the rotor vane slots further defining spring pockets on the first and second ends of the rotor, each spring pocket having a bottom;

springs displaced within the spring pockets, the springs having first and second ends, the first ends of the springs in contact with the bottoms of the spring pockets;

buttons in communication with the second ends of the springs;

rotor vanes having outer edges defining notches exhibiting outer lips; the notches abutting on upper surface of each button; and a stator, the stator defining an annular space between the stator and rotor.

2. The apparatus of claim 1 in which the springs are helical.

3. The apparatus of claim 2 in which the buttons include extensions extending into the helical springs.

4. The apparatus of claim 3 in which the upper surfaces of the buttons have chamfered surfaces.

* * * * *